US005921903A

United States Patent [19]

Lawrence

[11] Patent Number: 5,921,903

[45] Date of Patent: Jul. 13, 1999

[54] ABDOMINAL EXERCISING DEVICE

[75] Inventor: Steve A. Lawrence, 6254 Lafayette Way, Dallas, Tex. 75230

[73] Assignee: Steve A. Lawrence, Dallas, Tex.

[21] Appl. No.: 08/907,703

[22] Filed: Aug. 8, 1997

[51] Int. Cl.[6] ..... A63B 23/02

[52] U.S. Cl. ..... 482/140; 482/131; 482/139

[58] Field of Search ..... 482/10, 95, 105, 482/106, 121–124, 126, 131, 139, 140, 148, 907; 602/18; 606/240; 21/686–691; D24/64, 191

[56] References Cited

U.S. PATENT DOCUMENTS

| | | | |
|---|---|---|---|
| D. 385,601 | 10/1997 | Uen | D21/191 |
| 1,012,802 | 12/1911 | Brogan . | |
| 4,335,875 | 6/1982 | Elkin . | |
| 4,456,249 | 6/1984 | Calabrese . | |
| 5,004,228 | 4/1991 | Powers . | |
| 5,069,449 | 12/1991 | Wardwell . | |
| 5,088,158 | 2/1992 | Burkholder | 128/879 |
| 5,122,107 | 6/1992 | Gardner . | |
| 5,167,602 | 12/1992 | Lehktman . | |
| 5,169,372 | 12/1992 | Tecco . | |
| 5,230,679 | 7/1993 | Olsen . | |
| 5,267,931 | 12/1993 | Faetini . | |
| 5,295,949 | 3/1994 | Hathaway . | |
| 5,637,067 | 6/1997 | Ausmus | 482/140 |
| 5,792,035 | 8/1998 | Ward et al. | 482/140 |

*Primary Examiner*—Jeanne M. Clark
*Attorney, Agent, or Firm*—Sidley & Austin

[57] ABSTRACT

An abdominal exercise device (10) is disclosed to facilitate exercise of the abdominal muscles. The device includes a foam pad support (12) to support the head, upper back and neck. A strap (14) is secured to the support (12) by a plurality of ties (24). The strap forms first and second handles (34, 36) which extend to first and second ends (16, 18). First and second grips (20, 22) are mounted at the first and second ends (16, 18), respectively. The length of the handles (34, 36) are adjustable. The user positions the support (12) behind the neck and grasps the grips (20, 22) to assist in abdominal muscle exercise.

1 Claim, 1 Drawing Sheet

ABDOMINAL EXERCISING DEVICE

TECHNICAL FIELD

This invention relates to a device to assist in abdominal exercises.

BACKGROUND OF THE INVENTION

Exercise is seen as an ever more important mechanism by which to live a healthier and fuller life. One of the important muscle groups to exercise is the abdominal muscles.

A number of devices have been developed to facilitate abdominal muscle exercise. However, these devices tend to be complicated, difficult to use and expensive. A need therefore exists for an improved abdominal muscle exercising device which is simple to use, inexpensive and effective.

SUMMARY OF THE INVENTION

In accordance with one aspect of the present invention, an abdominal exercise device is provided which includes a support and a strap secured to the support and extending to first and second ends. A first hand grip is mounted at the first end and a second hand grip is mounted at the second end.

In accordance with another aspect of the present invention, a reinforcing strip is mounted on the support and a plurality of ties secure the strap and reinforcing strip to the support. The support can be made of a foam pad. The strap can be made of a nylon strap, the grips can be made of vinyl and the ties can be conventional cable ties. The support is used to support the head, neck and upper back.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION OF THE INVENTION

Figure 1:
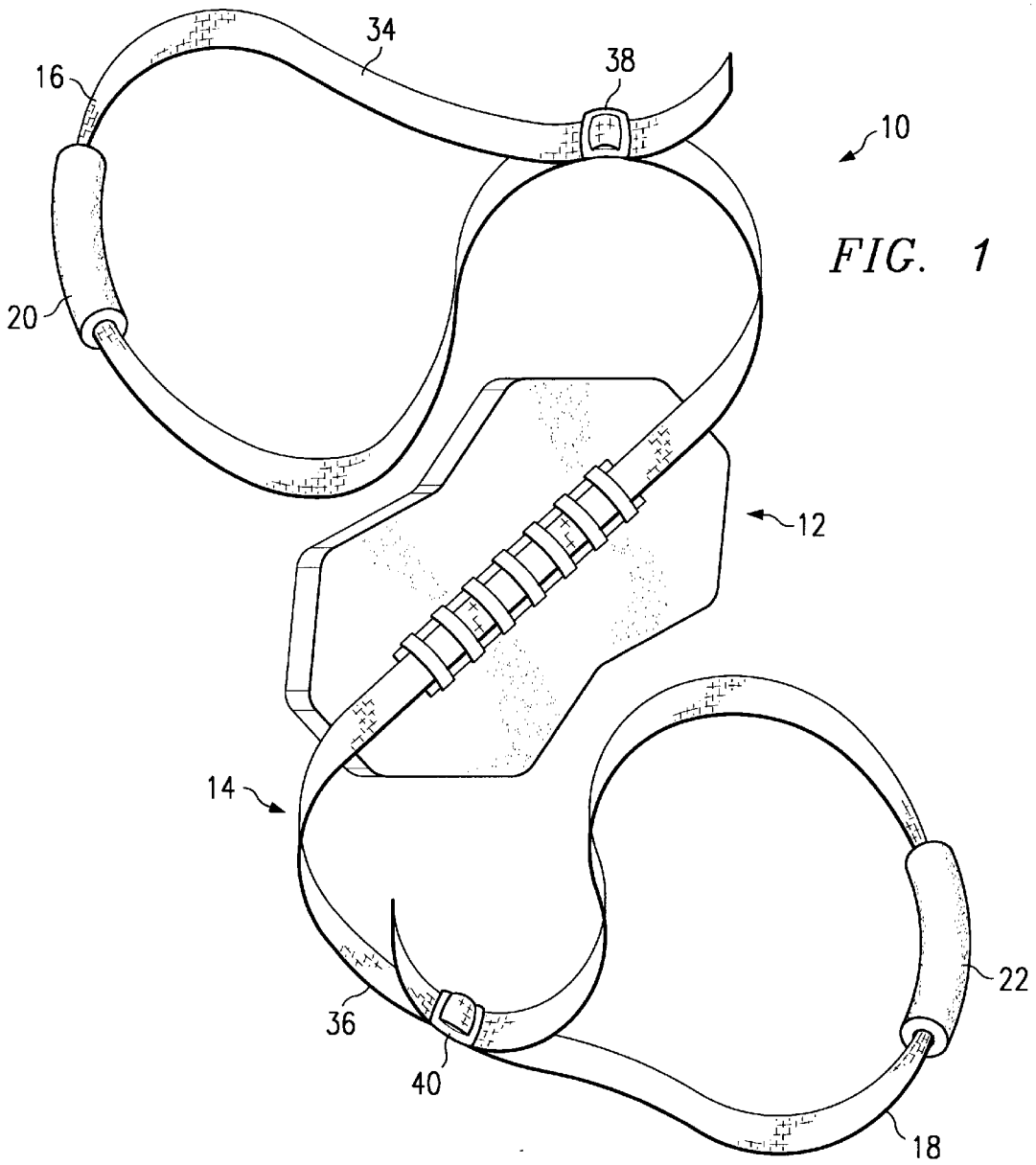
FIG. 1 is a perspective view of an exercise device forming a first embodiment of the present invention.
Figure 2:
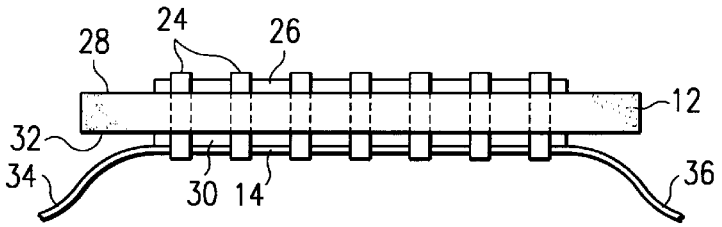
FIG. 2 is a side view of the support illustrating the strap secured thereto.

With reference to FIGS. 1 and 2, an abdominal exercise device 10 is illustrated which forms a first embodiment of the present invention. Device 10 includes a support 12 preferably formed of a foam pad, and a strap 14 secured to the support 12 near the middle of the strap 14 to therefore define first and second handles 34 and 36 extending to a first end 16 and second end 18, respectfully. The strap 14 is preferably formed of a nylon strap. At the first end 16 of strap 14 is mounted a first grip 20. Similarly, at the second end 18 of strap 14 is mounted a second grip 22. The grips 20 and 22 are preferably formed of vinyl.

With particular reference to FIG. 2, strap 14 can be seen to be secured to the support 12 by a plurality of ties 24, preferably of the type used to tie cables together. An inner (anterior) reinforcing strip 26 is positioned on the inner surface 28 of the support 12 and an outer (posterior) reinforcement strip 30 is positioned on the outer surface 32 of the support 12 where the ties are secured to reinforce the support 12 at the point of attachment between the strap 14 and support 12.

Preferably, the support 12 has dimensions of about 10 inches by six inches. The support 12 is semi-flexible and can form to the contours of the back of the neck, head and upper back. The strap 14 is preferably about eight feet to nine feet long. The strap is evenly distributed across the support 12 to produce equal length handles on both sides of the support. The reinforcing strips 26 and 30 are preferably about one inch wide by seven inches long and assist the ties 24 in securing the strap 14 to the support 12. The grips 20 and 22 are preferably about 6 inches long and 1 inch in diameter. Other mechanisms to attach the strap 14 to the support 12 can be used, such as glue, stitches, Velcro, snaps and buttons and the like, to supplement ties 24 or in substitute therefor, however, the use of ties 24 is preferred. Use of ties 24 allow some movement of strap 14 lengthwise relative to support 12 to reduce stress on support 12, but with sufficient resistance to facilitate use of the device.

The purpose of the device 10 is to facilitate proper form while exercising the abdominal muscles, such as by executing a crunch movement, and to provide support to the upper back, neck and head. The user would typically lay on a floor or exercise mat. The support 12 would be placed behind the head on the back of the neck and the length of the handles 34 and 36 would be adjusted at buckles 38 and 40 so that the arms, when grasping grips 20 and 22, are bent at about 20 degrees at the elbow. With the chin up, head against the support 12, hands in the grips 20 and 22 and the arms extended in front of the body and close to the body, the exercise includes pushing against the grips 20 and 22, raising the shoulder blades off of the mat, and pressing the lower back against the floor. This allows the basic crunch movement to occur with the assistance from the device 10. For additional assistance, the user can push forcefully against the handles.

The device 10 will provide for correct form, upper back, neck and head support, isolation of the abdominals, sustained muscular endurance, increased abdominal strength, increased lower back strength, reduce lower back fatigue, reduced weight, help define the waist contour and increase muscle tone, among other advantages. The device 10 also is small, easy to use, affordable, convenient, lightweight, washable, and is readily adaptable to personal ownership, allowing the user to feel confident in being the sole user of the device, eliminating the concerns relating to use of exercise devices shared with others. Preferably, the device 10 can be carried in a mesh bag for even more convenient use.

Another advantage of the present invention is that it can be used not only as a simple, effective device by beginners, but also by trained athletes to enhance the muscle tone, strength, and appearance of the abdomen.

The present invention can also be used for many other exercises. The strap 14 can be used for stretching by placing one foot into a handle 34 or 36 while sitting on the floor and pulling on the strap 14, facilitating a stretching movement for legs and back. It can also be used for stretching the upper body, arms, shoulders and chest. Another use can be a manual resistance exercise for strength training movement for almost every muscle group. Therefore, not only can the invention be used to exercise the abdominals, but can also be used as a stretching device and to provide manual resistance for strength building exercises.

Although a single embodiment of the invention has been illustrated in the accompanying drawings, and described in the foregoing detailed description, it will be understood that the invention is not limited to the embodiment disclosed, but is capable of numerous rearrangements, modifications and substitutions of parts and elements without departing from the scope and spirit of the invention.

I claim:

1. An abdominal exercise device, comprising:

a support;

a strap secured to the support and extending to first and second ends;

a first hand grip mounted at the first end;

a second hand grip mounted at the second end;

a plurality of ties securing the strap to the support; and at least one reinforcing strip positioned between the strap and the support and secured thereto by the ties to reinforce the attachment of the strap to the support.

* * * * *

UNITED STATES PATENT AND TRADEMARK OFFICE

CERTIFICATE OF CORRECTION

PATENT NO : 5,921,903

DATED : July 13, 1999

INVENTOR(S) : Steve A. Lawrence

It is certified that error appears in the above-identified patent and that said Letters Patent is hereby corrected as shown below:

On the title page,

IN THE ABSTRACT

Please correct the next to the last sentence in the abstract to read as follows:

--The length of the handles (34, 36) is adjustable.--.

Column 2, line 36, change "reduce" to --reduced--.
Column 2, line 37, change "help define" to --help in defining--.
Column 2, line 37, change "increase" to --increased--.

Signed and Sealed this

Ninth Day of May, 2000

*Attest:*

Q. TODD DICKINSON

*Attesting Officer*

*Director of Patents and Trademarks*